US009045294B2

(12) United States Patent
Suzuki

(10) Patent No.: US 9,045,294 B2
(45) Date of Patent: Jun. 2, 2015

(54) SHEET FEEDING DEVICE, IMAGE FORMING DEVICE, AND METHOD FOR FEEDING SHEETS

(71) Applicants: KABUSHIKI KAISHA TOSHIBA, Tokyo (JP); Toshiba Tec Kabushiki Kaisha, Tokyo (JP)

(72) Inventor: Akitoshi Suzuki, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/957,362

(22) Filed: Aug. 1, 2013

(65) Prior Publication Data

US 2014/0042688 A1 Feb. 13, 2014

(30) Foreign Application Priority Data

Aug. 7, 2012 (JP) ..... 2012-174891

(51) Int. Cl.

*B65H 5/00* (2006.01)
*B65H 7/20* (2006.01)
*B65H 3/44* (2006.01)

(52) U.S. Cl.

CPC ..... *B65H 5/00* (2013.01); *B65H 3/443* (2013.01); *B65H 7/20* (2013.01); *B65H 2405/332* (2013.01); *B65H 2511/40* (2013.01); *B65H 2513/51* (2013.01); *B65H 2801/06* (2013.01)

(58) Field of Classification Search

CPC ..... B65H 2405/332; B65H 2513/51; B65H 2511/40; B65H 5/00; B65H 7/20; B65H 3/443

USPC ..... 271/9.01, 9.11–9.13, 9.02, 9.04; 399/391

See application file for complete search history.

(56) References Cited

U.S. PATENT DOCUMENTS

| | | | | | |
|---|---|---|---|---|---|
| 4,548,394 | A * | 10/1985 | Koyama et al. | 271/9.11 |
| 4,625,955 | A * | 12/1986 | Snellman et al. | 271/9.11 |
| 4,879,578 | A * | 11/1989 | Hisajima et al. | 399/195 |
| 4,918,489 | A * | 4/1990 | Inage et al. | 399/391 |
| 5,323,220 | A * | 6/1994 | Yasuda | 399/391 |
| 5,327,207 | A * | 7/1994 | Otake et al. | 399/364 |
| 5,355,206 | A * | 10/1994 | Maruyama et al. | 399/396 |
| 6,582,039 | B2 * | 6/2003 | Johnson et al. | 347/3 |
| 6,597,889 | B2 * | 7/2003 | Johnson et al. | 399/393 |
| 7,480,467 | B2 * | 1/2009 | Ueki et al. | 399/23 |
| 7,540,484 | B2 * | 6/2009 | Mandel et al. | 271/9.04 |
| 7,976,011 | B2 * | 7/2011 | Shibuya | 271/9.02 |
| 2004/0247353 | A1 * | 12/2004 | Antinora | 399/382 |
| 2007/0047979 | A1 | 3/2007 | Ai | |

FOREIGN PATENT DOCUMENTS

| | | |
|---|---|---|
| JP | 2007-065323 | 3/2007 |

* cited by examiner

*Primary Examiner* — Patrick Cicchino
(74) *Attorney, Agent, or Firm* — Patterson & Sheridan, LLP

(57) ABSTRACT

According to one embodiment, a sheet feeding device for image forming apparatus has a first storing unit configured to store sheets therein, a second storing unit configured to store sheets therein and disposed farther from an image forming section of the image forming apparatus than the first storing unit, a feeding unit configured to feed sheets from the first and second storing units to the image forming section, and a control unit configured to control the feeding unit to feed a first sheet from the first storing unit and then to start feeding a second sheet from the second storing unit while the first sheet is being conveyed from the first storing unit.

21 Claims, 6 Drawing Sheets

SHEET FEEDING DEVICE, IMAGE FORMING DEVICE, AND METHOD FOR FEEDING SHEETS

CROSS-REFERENCE TO RELATED APPLICATION

This application is based upon and claims the benefit of priority from Japanese Patent Application No. 2012-174891, filed Aug. 7, 2012, the entire contents of which are incorporated herein by reference.

FIELD

Embodiments described herein relate generally to a technique for feeding sheets by changing cassettes from which sheets are fed.

BACKGROUND

Conventionally, there has been known an image forming device having a function of automatically switching a cassette from which sheets are fed (this function being referred to as an APS or automatic cassette change hereinafter). In such an image forming device, where sheets having the same size, the same direction, and the same type (quality, thickness and the like of sheets) are stored in a plurality of cassettes, when sheets stored in one cassette are used up, sheet feeding is automatically switched such that sheets are fed from another cassette and the formation of images can be continued.

In a conventional image forming device having the APS, when sheets of the same kind are stored in a plurality of cassettes, sheet feeding is performed by assigning priority to an upper cassette, that is, the cassette arranged closest to an image forming unit of the image forming device. This is because a time required for a sheet to arrive at the image forming unit is shorter in case of the sheet being fed the upper cassette compared to a lower cassette. Further, on a display screen which allows a user to select the cassette from which sheets are fed, the layout of the image forming device is made such that the user is likely to select the upper cassette, and hence the user tends to select the upper cassette.

Accordingly, sheets stored in the upper cassette are likely to be used up earlier than sheets stored in the lower cassettes. Thus, in an automatic cassette change which is performed when the stored sheets are used up, the sheet feeding cassette tends to be switched from an upper cassette to a lower cassette in many cases.

DETAILED DESCRIPTION

Figure 1:
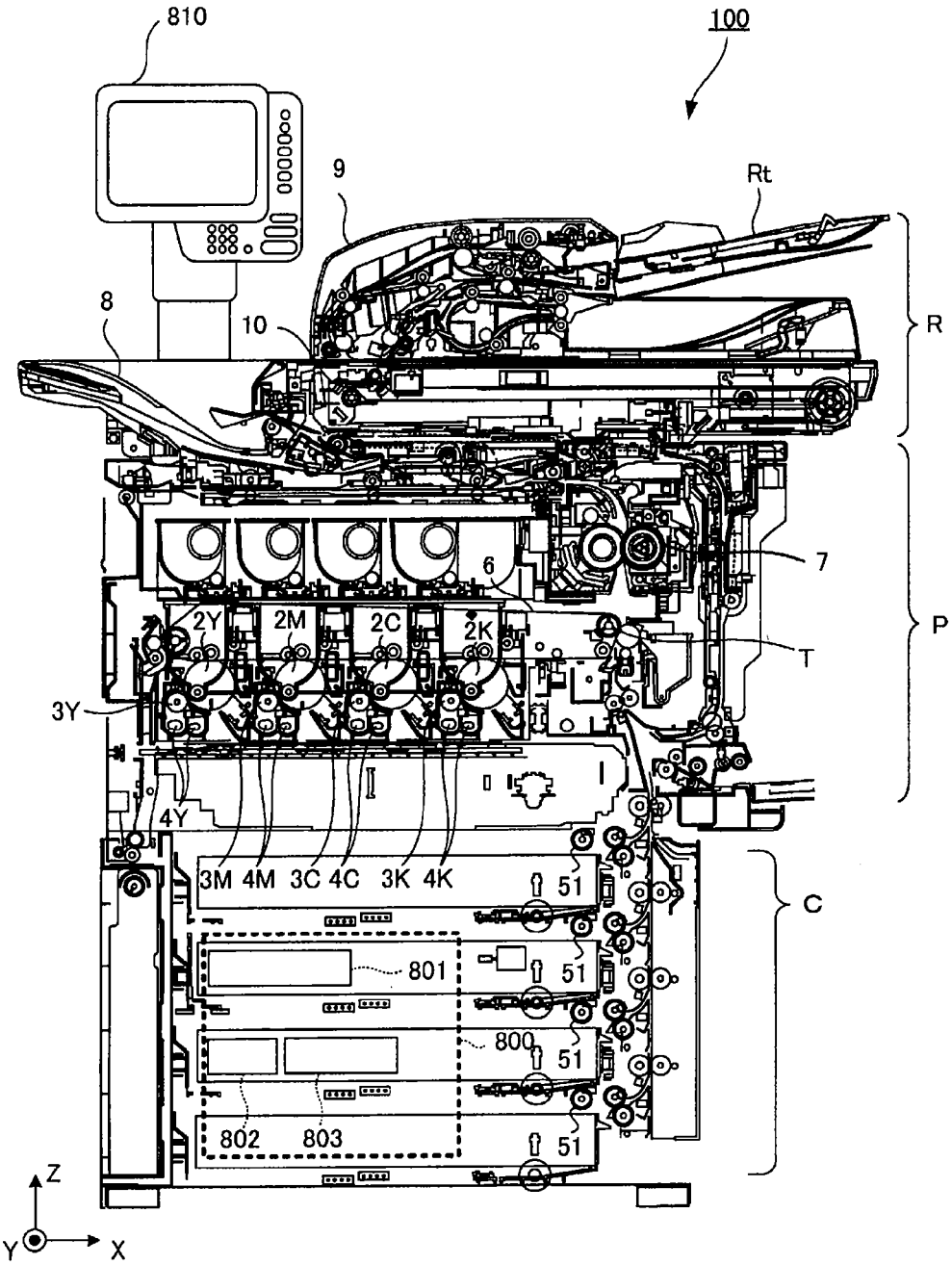
FIG. 1 is a cross-sectional view of an image forming device according to one embodiment.

Conventionally, in switching the sheet feeding cassette, an operation of feeding sheets from the lower cassette by controlling the rotation of a pickup roller corresponding to the lower cassette is started after it is detected that sheets in the upper cassette have been used up. Because a detection of a used-up state in the upper cassette and a feeding of the sheets based on the detection requires some time, there is a time lag between the used-up of the sheets in the upper cassette and the feeding of sheets from the lower cassette. Thus, there is an unnecessary time interval between the final sheet being fed from the upper cassette and the subsequent sheet being fed from the lower cassette, and therefore efficient sheet feeding is not performed.

In order to overcome the above drawbacks, an embodiment is directed to shorten the time interval between the final sheet being fed from the upper cassette and the subsequent sheet being fed from the lower cassette and to decrease the number of sheets fed from the upper cassette.

In general, according to one embodiment, a sheet feeding device for image forming apparatus has a first storing unit configured to store sheets therein, a second storing unit configured to store sheets therein and disposed farther from an image forming section of the image forming apparatus than the first storing unit, a feeding unit configured to feed sheets from the first and second storing units to the image forming section, and a control unit configured to control the feeding unit to feed a first sheet from the first storing unit and then to start feeding a second sheet from the second storing unit while the first sheet is being conveyed from the first storing unit.

In the image forming device according to this embodiment, only a first sheet in a print job, a copy job, or a FAX reception job (hereinafter simply referred to as a job) is fed from an upper cassette, and a second sheet and succeeding sheets are fed from one of lower stage cassettes. Due to such an operation, the number of sheets fed from the upper cassette can be decreased. Further, as cases where a plurality of sheets are printed in one job is more usual than cases where only one sheet is printed in one job, the sheets stored in the lower cassette may be used up sooner than the sheets stored in the upper cassette. Accordingly, with respect to an automatic cassette change which is performed when the sheets are used up, chances that the sheet feeding cassette is switched from the lower cassette to the upper cassette may be more frequent.

In switching the sheet feeding cassette, after it is detected that sheets in the lower cassette have been used up, a switching control is carried out on a pickup roller and the like so that a sheet feeding operation from the upper cassette is started. Since the sheet is fed from the upper cassette closer to the image forming unit after the sheet feeding cassette is switched, an arrival time of a sheet to the image forming unit can become earlier. Further, while the last sheet from the lower cassette is being conveyed upward, a switching control to the upper cassette (the switching control carried out on the rollers and the like) is performed parallel to the conveyance of the last sheet from the lower cassette. Accordingly, a sheet feeding time can be shortened compared to a conventional automatic cassette change from an upper cassette to a lower cassette correspondingly. That is, conventionally, the sheet feeding cassette is switched from the upper cassette to the lower cassette, and hence there is a time interval between the sheet being lastly fed from the upper cassette and the sheet being first fed from the lower cassette. According to this embodiment, however, a sheet feeding time associated with the switch of the sheet feeding cassette can be shortened, and hence the time interval can be shortened.

In the image forming device according to this embodiment, when the sheet feeding cassette is switched from the upper cassette to the lower cassette, a timing at which the sheet starts to be fed from the lower cassette is set as close as possible to a timing at which the sheet starts to be fed from the upper cassette. Accordingly, a time lag which occurs upon switching the sheet feeding cassette from the upper cassette to the lower cassette can be shortened.

Hereinafter, the exemplary embodiment is explained in reference to drawings. FIG. 1 is a longitudinal cross-sectional view of an image forming device (MFP: Multi Function Peripheral) according to the embodiment. As shown in FIG. 1, an image forming device 100 includes a reading part R, an image forming part P, and a cassette part C.

The reading part R has a function of reading an image formed on a sheet document or a book document by scanning, and also has a function of acquiring image data transmitted to the image forming device 100 from an external apparatus. The reading part R has a scanning part 10 which includes a plurality of mirrors and a light receiving element, and also has an automatic document conveying device (ADF: Auto Document Feeder) 9 which is capable of automatically conveying a document to a predetermined location where the document is to be placed. An image formed on a document which is placed on a document tray Rt and is automatically conveyed by the automatic document conveying device 9 or an image formed on a document placed on a document platen is read by the scanning part 10.

The image forming part P is an image forming unit, and has a function of forming a developer image on the sheet based on an image read from the document by the reading part R, or image data transmitted from the external apparatus, or the like. The image forming part P includes: photosensitive elements 2Y to 2K; developing rollers 3Y to 3K; mixers 4Y to 4K; an intermediate transfer belt 6, a fixing device 7; and a discharge tray 8.

The cassette part C has a plurality of cassettes (feeding parts) where sheets, which are objects on which an image is formed, are stored. Each cassette is provided with a pickup roller 51 for picking up the stored sheet. In this embodiment, the cassette part C includes four cassettes which are stacked in the vertical direction (Z-axis direction). As can be also understood from FIG. 1, the uppermost stage cassette is the cassette closest to the image forming part P, and the lowermost stage cassette is the cassette farthest from the image forming part P. Further, in this embodiment, it is assumed that there are at least two cassettes, the sheets stored in which have the same size, the same direction, and the same type.

The image forming device 100 has a control board 800. The control board 800 includes: a processor 801, which is an arithmetic operation unit (for example, CPU (Central Processing Unit) and an MPU (Micro processing Unit)); an ASIC (Application Specific Integrated Circuit) 802; and a memory 803, which is a storage part having a volatile storage device and a non-volatile storage device. The processor 801 performs various processing in the image forming device 100, and carries out various functions by executing programs prestored in the memory 803. The memory 803 may be comprised of an SRAM (Static Random Access Memory), a DRAM (Dynamic Random Access Memory), a VRAM (Video RAM), an FROM (Flash Read Only Memory), and a hard disk drive, and the like. The memory 803 stores various pieces of information and programs to be used by the image forming devise 100.

The image forming device 100 has a control panel 810. The control panel 810 receives instructions from a user, and displays contents of processing to the user.

Hereinafter, as one example of processing in the image forming device 100, a summary of copy processing is explained. Firstly, a sheet picked up by the pickup roller 51 is fed to a sheet conveying passage. The sheet fed to the sheet conveying passage is conveyed in a predetermined conveying direction by a plural pairs of rollers.

A plurality of sheet documents which are continuously and automatically conveyed by the automatic document conveying device 9 or a sheet document which a user places on a document platen are/is read by the scanning part 10.

Next, the control board 800 executes predetermined image processing to image data readout from the document by the reading part R. Thereafter, an electrostatic latent image portion corresponding to the image data after the image processing is executed is formed on photosensitive surfaces of the photosensitive elements 2Y, 2M, 2C, and 2K from which developer images of Y (yellow), M (magenta), C (cyan) and K (black) are to be transferred to the sheet.

Subsequently, each of developers which are stirred by each of the mixers 4Y, 4M, 4C, and 4K in each of the developing units are supplied to each of the photosensitive elements 2Y, 2M, 2C, and 2K. On each of the photosensitive element, the electrostatic latent image is formed as described above by each of the developing rollers (so-called magnetic rollers) 3Y, 3M, 3C, and 3K. Accordingly, the electrostatic latent image portion formed on each of the photosensitive surfaces of the photosensitive elements turns into a visible image portion.

Each of the developer image portion formed on each of the photosensitive elements in this manner is transferred to a belt surface of the intermediate transfer belt 6 (so-called primary transfer), and a developer image is formed of the developer image portions on the intermediate transfer belt 6. The developer image is then conveyed by the rotation of the intermediate transfer belt and transferred to a sheet conveyed at a predetermined secondary transfer position T.

The developer image transferred onto the sheet is fixed by the fixing device 7 heating the sheet. The sheet onto which the developer image is fixed by heating is conveyed by plural pairs of conveying rollers and is discharged onto the discharge tray 8.

Next, an example of operation of a sheet feeding operation according to this embodiment is explained. In this embodiment, when a plurality of sheets is printed in one print job, a first sheet is fed from the upper cassette, and a second and one or more subsequent sheets are fed from the lower cassette. The sheets having the same size and the same direction are stored in both the upper and lower cassette. This control of sheet feeding is performed in such a manner that the control board 800 controls the rotation of the pickup roller 51. This operation is also performed in such a manner that the processor 801 included in the control board 800 loads a control program stored in the memory 803 in advance and executes an arithmetic operation based on the control program. The ASIC802 may perform a part or the whole of this function.

When the second sheet is fed from the lower cassette, if the second sheet starts to be fed after feeding of the first sheet is completed (in this embodiment, a state where a tail end of the sheet in the conveying direction passes the pickup roller 51), there is an interval between the first sheet and the second sheet, because there is a spatial distance between the upper cassette and the lower cassette and the second sheet needs to be conveyed along the sheet conveying passage by the distance. To reduce a time loss due to the interval, according to this embodiment, a time interval between the start of feeding the first sheet from the upper cassette and the start of feeding the second sheet from the lower cassette is made as short as possible.

Figure 2:
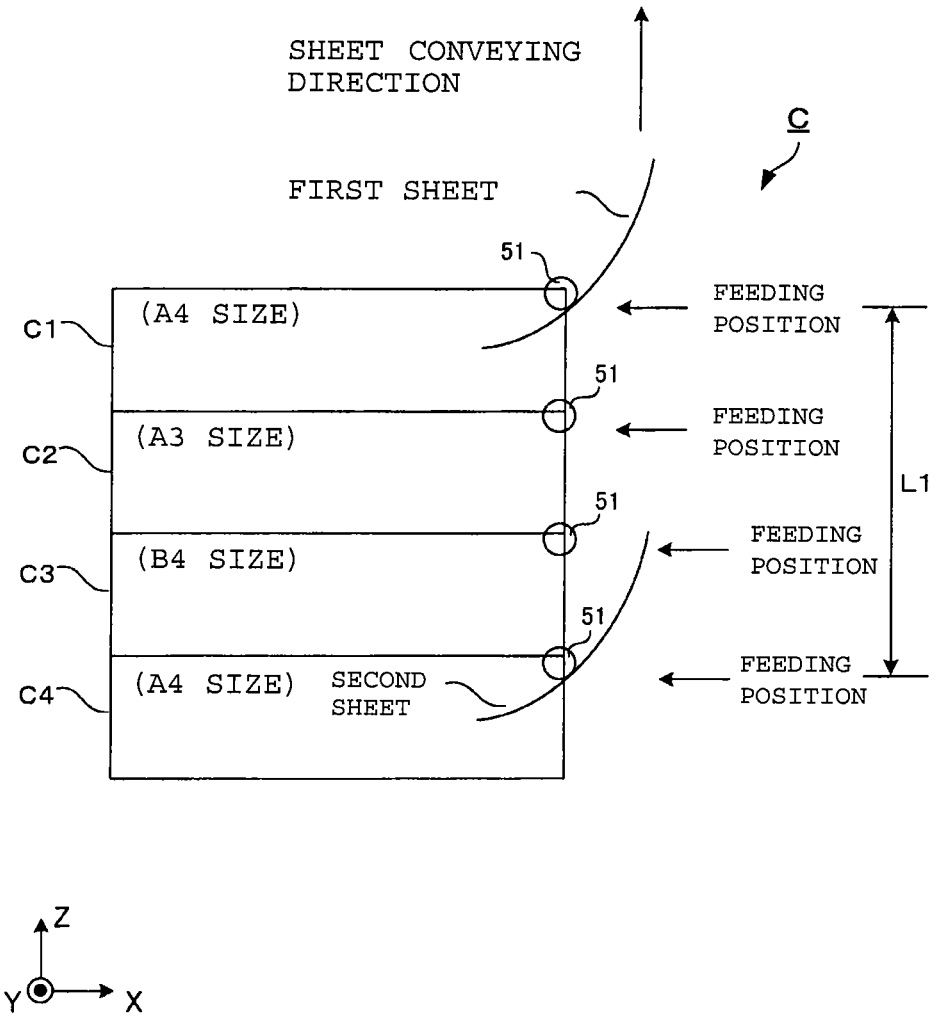
FIG. 2 is a schematic diagram showing a situation in which a first sheet and a second sheet simultaneously start to be fed in one print job according to the embodiment.

FIG. 2 exemplifies a case where, in a configuration of four cassettes, sheets having A4 size are stored in the same direction in the uppermost cassette C1 and the lowest cassette C4, and the first sheet is fed from the cassette C1 and the second and subsequent sheets are fed from the cassette C4.

Here it is assumed that a time between the start of feeding the first sheet (a timing at which the pickup roller 51 is brought into contact with the sheet) and completion of feeding of the sheet is Tx. Also it is assumed that a time between the start of feeding the second sheet and the arrival of a front end of the second sheet in the conveying direction at a feeding position of the cassette C1 is $T_Y$. In this embodiment, the feeding position is assumed to be a position in the Z axis direction at which the pickup roller 51 is brought into contact with the sheet. If the relationship $T_Y>T_X$ is satisfied, even when the sheets simultaneously start to be fed from the cassette C1 and the cassette C4, there is no possibility that the first sheet and the second sheet interfere and overlap with each other. Accordingly, in this case, the control board 800 controls the pickup rollers 51 such that the first sheet and the second sheet simultaneously start to be fed from the cassettes.

Figure 3:
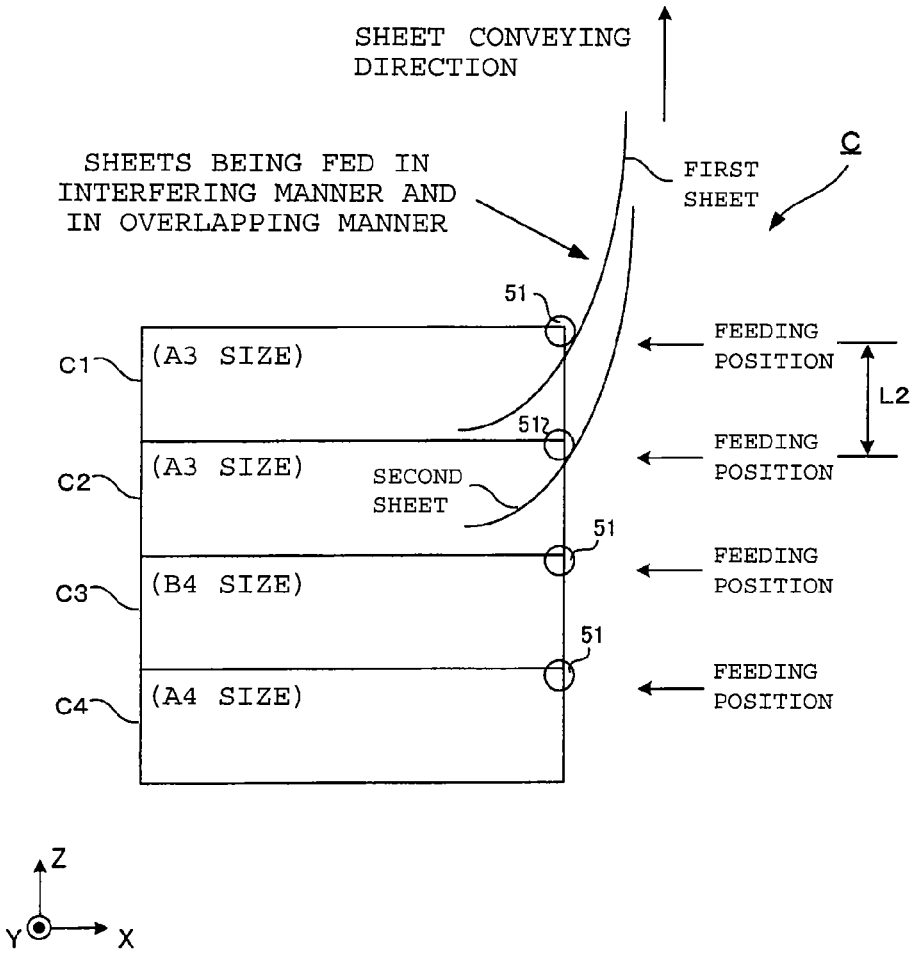
FIG. 3 is a schematic diagram showing a situation in which sheets overlap with each other due to the simultaneous feeding.

As in the case of the example shown in FIG. 2, when a sheet size is relatively small and the distance L1 between the cassettes is sufficiently long, there arises no problem even when the first sheet and the second sheet simultaneously start to be fed. However, in a case where a sheet size is larger or a spatial distance between the upper cassette and the lower cassette is short, when the feeding of the first sheet and the feeding of the second sheet are started simultaneously, the first sheet and the second sheet are fed in an overlapping manner and in an interfering manner. FIG. 3 exemplifies a case where sheets of A3 size are stored in the cassette C1 and a cassette C2, which is a cassette arranged directly below the cassette C1, and the first sheet is fed from the cassette C1 and the second and subsequent sheets are fed from the cassette C2. FIG. 3 also shows a state where the first sheet and the second sheet simultaneously start to be fed. In the simultaneous feeding of the sheets, in the example shown in FIG. 3, before the first sheet passes the feeding position of the cassette C1, the front end of the second sheet in the conveying direction reaches the feeding position of the cassette C1. That is, the relationship $T_Y<T_X$ is satisfied, and hence the first sheet and the second sheet are conveyed in an overlapping manner.

In this manner, in the example shown in FIG. 3, when the feeding of the first sheet and the feeding of the second sheet are simultaneously started, the sheets interfere with each other. Accordingly, in this embodiment, a delay time is provided such that the second sheet starts to be fed the delay time after the first sheet starts to be fed. Further, to set the delay time such that the delay time is not so long from the start of feeding of the first sheet, in this embodiment, the delay time is controlled so as to be substantially equal to a delay time when all sheets are fed only from the upper stage cassette, for example.

A method of calculating the delay time is explained hereinafter. It is assumed that a time from the start of feeding the first sheet to the start of feeding the second sheet is 3 seconds when the sheets are fed only from the cassette C1, and that a time which the second sheet fed from the lower cassette C2 requires to cover the distance L2 after the start of feeding the second sheet is 1.8 seconds. In this case, the delay time is calculated as follows.

$$3.0(\text{sec})-1.8(\text{sec})=1.2(\text{sec})$$

When the second sheet starts to be fed from the lower cassette C2 after 1.2 seconds lapsed from the start of feeding the first sheet, a time gap of the two sheets fed to the image forming part P becomes equal to a time gap in the case in which both the first and second sheets start to be fed from the cassette C1.

Figure 4:
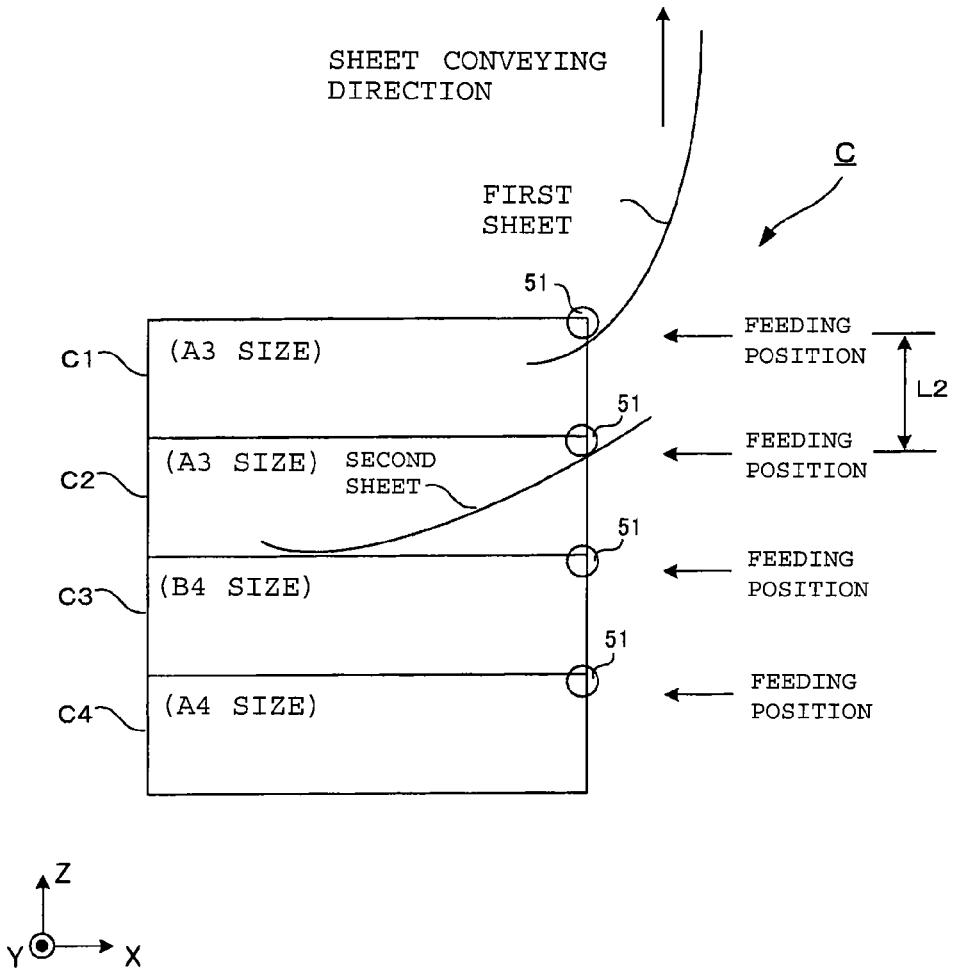
FIG. 4 is a schematic diagram showing a situation in which sheets do not overlap with each other according to the embodiment.

Based on such calculation, in the case of the example shown in FIG. 3, the control board 800 controls the pickup rollers 51 such that the feeding of the second sheet from the cassette C2 is started 1.2 seconds after the start of feeding the first sheet from the cassette C1. FIG. 4 shows a sheet feeding state when a delay time is provided. With the delay time of 1.2 seconds and by starting to feed the second sheet while the first sheet in the upper cassette is fed towards the image forming part P by the pickup roller 51, the control board 800 performs a control such that the second sheet in the lower cassette is fed toward the image forming part P by the pickup roller 51 in parallel to the feeding of the first sheet in the upper cassette. Accordingly, the sheet can be fed from the cassette C2, which is the lower cassette, in the same manner as the feeding of the sheets only from the cassette C1.

The above-mentioned "3 seconds" is calculated based on a sheet size, and "1.8 seconds" is calculated based on the distance between the cassettes. Accordingly, the delay time can be calculated based on the sheet size and the distance between the cassettes. That is, assuming a sheet size of a printing object as $S_{size}$, the distance between the cassettes as L, and $\alpha$ and $\beta$ as coefficients defined in advance, the delay time D can be calculated using the following formula.

$$D=\alpha S_{size}-\beta L \tag{1}$$

While the above-mentioned "1.8 seconds" is precisely the number calculated based on the distance between the pickup roller 51 corresponding to the upper cassette and the pickup roller 51 corresponding to the lower cassette, both of which are sheet feeding positions, the above-mentioned 1.8 seconds can be regarded as the number calculated based on the distance between the cassettes in this embodiment, because the shape of the cassettes and the arrangement position of the pickup roller are equal among the cassettes.

A sheet size $S_{size}$ of a printing object can be acquired based on the input by a user on the control panel 810 or based on a preset value in a job, and the distance L between the cassettes can be acquired from the identification numbers of the cassettes. For example, to set identification numbers allocated to the cassette C1 to the cassette C4 as 1 to 4 in order, the distance from the cassette C4 to the cassette C1 can be acquired by multiplying a value obtained by subtracting the identification number of the cassette C1 from the identification number of the cassette C4 (4−1=3) by a thickness (a height in the Z axis direction) of the cassette defined in advance.

The control board 800 calculates a delay time as required using the formula 1 every time a new job is issued, and performs a control such that the start of the sheet feeding from the lower cassette is delayed by the calculated time. As another embodiment, a table in which the distance between the cassettes, a sheet size, and a delay time are associated with each other may be stored in the memory 803 in advance, and the control board 800 may acquire the delay time from the table. In this case, the control board 800, each time a print job is ordered, calculates the distance between the cassettes based on the identification numbers of the cassettes, and acquires the delay time by referring to a part of the table corresponding to the distance and the sheet size. Thereafter, the control board 800 performs a control such that the start of sheet feeding from the lower cassette is delayed by the acquired delay time.

When the delay time calculated using the formula 1 is a negative value, the relationship $T_Y>T_X$ which is explained in conjunction with FIG. 2 is also satisfied, and hence the control board 800 performs a control such that sheets start to be fed from the upper cassette and the lower cassette simultaneously when the delay time is a negative value.

Figure 5:
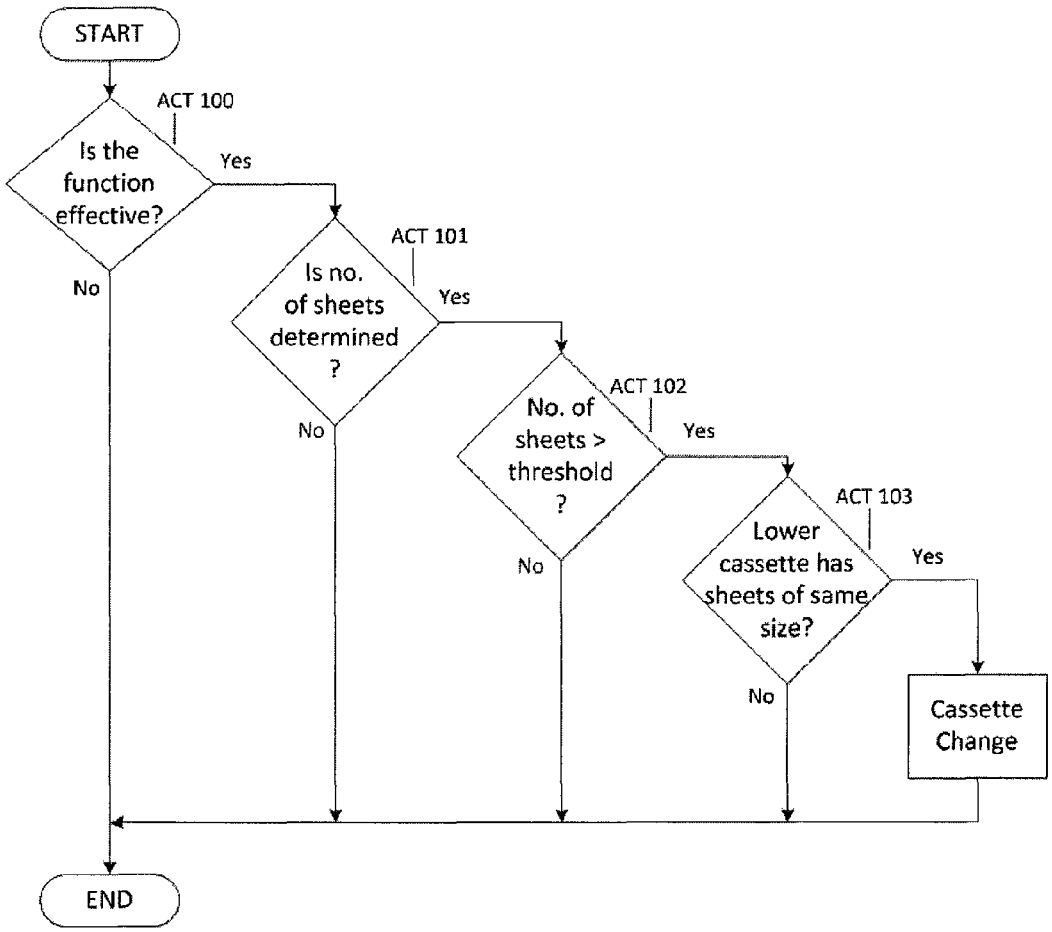
FIG. 5 is a flowchart showing an example of an operation of the image forming device according to the embodiment.
Figure 6:
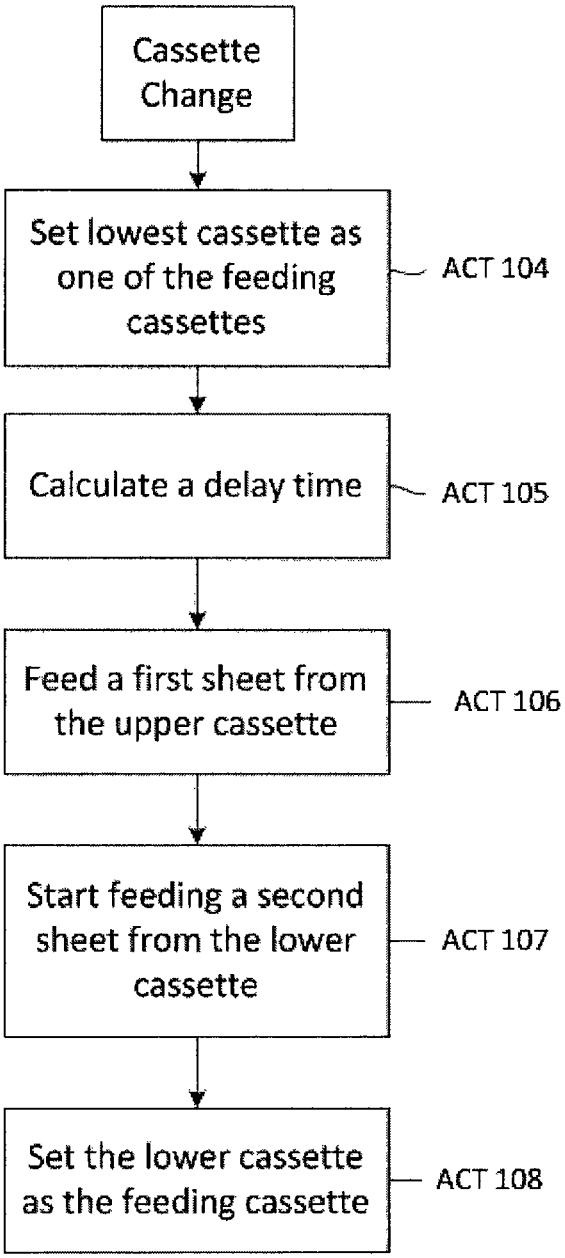
FIG. 6 is a flowchart showing an example of a cassette changing operation.

An example of operation of the image forming device 100 is explained in conjunction with a flowchart shown in FIG. 5 and FIG. 6. The control board 800 determines whether or not the above-mentioned control functions are effective by determining a mode value or the like which a user designates (ACT100). When the functions are effective (ACT100, Yes), the control board 800 determines whether or not the number of sheets to be printed is determined (ACT101). The number of sheets to be printed is determined based on the number of pages, the number of sets, and allocation set values of the document to be printed, and the control board 800 calculates and determines the number of sheets to be printed based on the information.

When the number of sheets to be printed is determined (ACT101, Yes), the control board 800 determines whether or not the number of sheets to be printed exceeds a threshold value (five, for example) (ACT102). The switch the feeding cassette imposes not a little burden on hardware, and hence when the switch is performed frequently, the consumption of the hardware is increased correspondingly. Accordingly, in this embodiment, the above-mentioned control is performed only when the number of sheets to be printed exceeds the predetermined number (i.e. five). The step of determining the threshold value may not be performed.

When the number of sheets to be printed exceeds the threshold value (ACT102, Yes), the control board 800 determines whether or not there is another cassette where sheets which have the same size, the same direction, and the same type are stored as sheets stored in a cassette designated by a user, and also determines whether or not such a cassette is arranged below the cassette designated by the user (ACT103). When the cassette is arranged below the cassette designated by the user (ACT103, Yes), the control board 800 determines the lowest cassette of one or more cassettes that satisfy the condition as the cassette from which the second and subsequent sheets are to be fed (ACT104). In the above-mentioned explanation made in conjunction with FIG. 2 to FIG. 4, the case where the number of cassettes in which sheets of the same size and the same type are loaded is two is mentioned. However, there may be a case where the number of cassettes is three or more, and hence, in this embodiment, among these cassettes, the lowest cassette is determined to be the cassette from which the second and subsequent sheets are to be fed.

The control board 800 calculates the distance between the cassettes based on the identification numbers or the like of the feeding cassettes, and calculates a delay time using the formula 1 based on the calculated distance and the sheet size designated by the user (ACT105). The ACT105 may be a step of acquiring the delay time by referring to the table.

The control board 800 controls the pickup roller 51 such that the first sheet in the job is fed from the upper cassette (ACT106). The control board 800 controls the pickup roller 51 such that the second sheet is fed from the determined lower cassette after the calculated delay time passes (ACT107). The control board 800 controls the pickup roller 51 such that the second and subsequent sheets are fed from the determined lower cassette (ACT108).

In the next step, the image forming part P executes a print processing to the fed sheets.

When the sheets stored in the lower cassette are used up due to feeding of the sheets, the control board 800 switches the feeding source such that the sheets are fed from the upper cassette successively. This switch is derived from the function of the APS. That is, upon detection of the used-up of the sheets in the lower cassette by a sensor or the like and upon reception of such a detection signal, the control board 800 controls the rotation of the pickup rollers 51. Due to such a control, the sheet feeding source is changed back from the lower cassette to the upper cassette. The control board 800 at least starts or preferably finishes such a switching control while the last sheet fed from the lower cassette is being conveyed to the image forming part P. Due to such a control, a time lag in feeding the sheet from the upper cassette can be reduced.

When the determinations made in ACT100 to ACT103 are negative, printing is performed using sheet fed from the cassette selected by the user (i.e., the cassette selected by a default state or automatically when such a selection by the user is not made), and when the sheets are used up, the switch of the sheet feeding source is carried out in accordance with a technique substantially equal to the related APS function.

In the above-mentioned embodiment, only one sheet is fed from the upper cassette. However, the present invention is not limited to such an embodiment. That is, an embodiment is possible in which the cassette is switched to the lower cassette from the upper cassette after the predetermined number of sheets are fed from the upper cassette. Further, a user may designate the predetermined number of sheets to be fed. That is, it is sufficient that the mounting is adopted where at least a sheet is fed from the upper cassette and subsequent sheets are fed from the lower cassette.

In the above-mentioned embodiment, the feeding part where the sheets are stored and from which the sheets are fed is formed of a cassette. Instead, it may be possible to use a tray-type feeding part. The formula 1 is not limited to such a formula, and various calculation formulae can be considered.

As explained in detail heretofore, according to the embodiment, the number of sheets fed from the cassette closer to the image forming unit can be decreased. Also, the performance of the sheet feeding device in switching a sheet feeding source can be enhanced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet feeding device for image forming apparatus comprising:

a first storing unit configured to store sheets therein;

a second storing unit configured to store sheets therein and disposed farther from an image forming section of the image forming apparatus than the first storing unit;

a first feeding unit configured to feed sheets from the first storing unit to the image forming section;

a second feeding unit configured to feed sheets from the second storing unit to the image forming section; and a control unit configured to determine a total number of sheets to be printed, a storing unit as designated by a user, and a storing unit that stores sheets of same size and type as sheets stored in the designated storing unit and is disposed farther from the image forming section than the designated storing unit, as a subsequent storing unit, and control the feeding units to feed a first sheet from the first storing unit if the first storing unit is determined as the designated storing unit, if the total number exceeds a threshold number and the second storing unit is determined as the subsequent storing unit, then to start feeding a second sheet from the second storing unit while the first sheet is being conveyed from the first storing unit, and if the total number does not exceed the threshold number or if no storing unit is determined as the subsequent storing unit, then to feed a second sheet from the first storing unit.

2. The sheet feeding device according to claim 1, wherein the first and second sheets are sheets that are fed to the image forming section during an image forming operation executed by the image forming apparatus.

3. The sheet feeding device according to claim 1, wherein the first sheet fed from the first storing unit is a sheet that is first fed to the image forming section during an image forming operation executed by the image forming apparatus.

4. The sheet feeding device according to claim 1, wherein the first sheet fed from the first storing unit is a sheet that is fed to the image forming section after a predetermined number of sheets have been fed from the first storing unit during an image forming operation executed by the image forming apparatus.

5. The sheet feeding device according to claim 1, wherein the control unit is configured to control the second feeding unit to feed one or more sheets following the second sheet from the second storing unit when the second sheet is fed from the second storing unit until the second storing unit becomes empty.

6. The sheet feeding device according to claim 5, wherein the control unit is configured to control the first feeding unit to feed one or more sheets from the first storing unit after the second storing unit becomes empty.

7. The sheet feeding device according to claim 1, wherein the control unit is configured to control the feeding units to feed the first and second sheets so that the first and second sheets do not overlap with each other.

8. The sheet feeding device according to claim 1, wherein the control unit is configured to control the second feeding unit to start feeding the second sheet with a predetermined timing calculated based on a size of the first sheet and a distance between a sheet feeding position of the first storing unit and a sheet feeding position of the second storing unit.

9. An image forming apparatus comprising:

an image forming section configured to form an image on a sheet; and a sheet feeding section comprising:

a first storing unit configured to store sheets therein;

a second storing unit configured to store sheets therein and disposed farther from an image forming section than the first storing unit;

a first feeding unit configured to feed sheets from the first storing unit to the image forming section;

a second feeding unit configured to feed sheets from the second storing unit to the image forming section; and a control unit configured to determine a total number of sheets to be printed, a storing unit as designated by a user, and a storing unit that stores sheets of same size and type as sheets stored in the designated storing unit and is disposed farther from the image forming section than the designated storing unit, as a subsequent storing unit, and control the feeding units to feed a first sheet from the first storing unit if the first storing unit is determined as the designated storing unit, if the total number exceeds a threshold number and the second storing unit is determined as the subsequent storing unit, then to start feeding a second sheet from the second storing unit while the first sheet is being conveyed from the first storing unit, and if the total number does not exceed the threshold number, or if no storing unit is determined as the subsequent storing unit, then to feed a second sheet from the first storing unit.

10. The image forming apparatus according to claim 9, wherein the first and second sheets are sheets that are fed to the image forming section during an image forming operation executed by the image forming apparatus.

11. The image forming apparatus according to claim 9, wherein the first sheet fed from the first storing unit is a sheet that is first fed to the image forming section during an image forming operation executed by the image forming apparatus.

12. The image forming apparatus according to claim 9, wherein the first sheet fed from the first storing unit is a sheet that is fed to the image forming section after a predetermined number of sheets are fed from the first storing unit during an image forming operation executed by the image forming apparatus.

13. The image forming apparatus according to claim 9, wherein the control unit is configured to control the second feeding unit to feed one or more sheets following the second sheet from the second storing unit when the second sheet is fed from the second storing unit until the second storing unit becomes empty.

14. The image forming apparatus according to claim 9, wherein the control unit is configured to control the feeding units to feed the first and second sheets so that the first and second sheets do not overlap with each other.

15. A method for feeding sheets from a sheet feeding device to an image forming section of an image forming apparatus, the sheet feeding device including a first storing unit configured to store sheets therein and a second storing unit configured to store sheets therein and disposed farther from an image forming section than the first storing unit, the method comprising:

determining a total number of sheets to be printed;

determining a storing unit as designated by a user;

determining a storing unit that stores sheets of same size and type as sheets stored in the designated storing unit and disposed farther from the image forming section than the designated storing unit, as a subsequent storing unit;

if the first storing unit is determined as the designated storing unit, and the total number does not exceeds a threshold number or no storing unit is determined as the subsequent storing unit, feeding a first sheet and then a second sheet from the first storing unit to an image forming section for printing; and if the first storing unit is determined as the designated storing unit, the total number exceeds the threshold number, and the second storing unit is determined as the subsequent storing unit, feeding a first sheet from the first storing unit to the image forming section and then a second sheet from the second storing unit to the image forming section while the first sheet is being conveyed from the first storing unit.

16. The method according to claim 15, wherein the first and second sheets are sheets that are fed to the image forming section during an image forming operation executed by the image forming apparatus.

17. The method according to claim 15, wherein the first sheet fed from the first storing unit is a sheet that is first fed to the image forming section during an image forming operation executed by the image forming apparatus.

18. The method according to claim 15, wherein the first sheet fed from the first storing unit is a sheet that is fed to the image forming section after a predetermined number of sheets are fed from the first storing unit during an image forming operation executed by the image forming apparatus.

19. The method according to claim 15, further comprising:

when the second sheet is fed from the second storing unit, feeding one or more sheets following the second sheet from the second storing unit until the second storing unit becomes empty.

20. The method according to claim 15, wherein the first and second sheets are fed so that the first and second sheets do not overlap with each other.

21. The sheet feeding device according to claim 1, wherein a plurality of storing units including the first and second storing units is provided, and the control unit determines the storing unit that stores sheets of same size and type as sheets stored in the designated storing unit and is disposed farther from the image forming section than other storing units that store sheets of same size and type as sheets stored in the designated storing unit, as the subsequent storing unit.

* * * * *